US005433068A

United States Patent [19]

Stahlecker

[11] Patent Number: 5,433,068

[45] Date of Patent: Jul. 18, 1995

[54] OPEN-END ROTOR SPINNING UNIT WITH PIVOTAL COVER HOUSING ASSEMBLY

[75] Inventor: Fritz Stahlecker, Ueberkingen, Germany

[73] Assignee: Hans Stahlecker, Sussen, Germany

[21] Appl. No.: 195,467

[22] Filed: Feb. 14, 1994

[30] Foreign Application Priority Data

Feb. 11, 1993 [DE] Germany ..... 43 04 088.8

[51] Int. Cl.[6] ..... D01H 4/08; D01H 1/16

[52] U.S. Cl. ..... 57/407

[58] Field of Search ..... 57/406, 407

[56] References Cited

U.S. PATENT DOCUMENTS

| | | | |
|---|---|---|---|
| 3,874,154 | 4/1975 | Stahlecker et al. | 57/407 |
| 3,922,840 | 12/1975 | Watanabe et al. | 57/407 |
| 4,030,279 | 3/1977 | Rambousek et al. | 57/407 |
| 4,059,947 | 11/1977 | Stahlecker | 57/407 |
| 4,660,374 | 4/1987 | Wassenhoven | 57/407 |
| 4,753,067 | 6/1988 | Landwehrkamp et al. | 57/407 |
| 4,769,984 | 9/1988 | Raasch et al. | 57/407 |

FOREIGN PATENT DOCUMENTS

| | | |
|---|---|---|
| 2112170 | 9/1972 | Germany . |
| 1815776 | 7/1982 | Germany . |
| 3636182 | 4/1988 | Germany . |

*Primary Examiner*—Daniel P. Stodola
*Assistant Examiner*—William Stryjewski
*Attorney, Agent, or Firm*—Evenson McKeown Edwards & Lenahan

[57] ABSTRACT

In the case of a device for open-end rotor spinning, the axles of the spinning rotor, the supply roller and the opening roller—in plan view—are arranged in parallel planes to each other. In side view the axles of the supply roller and the opening roller are arranged inclined compared to the horizontal axle of the spinning rotor. A driving shaft extends perpendicularly to the above mentioned planes and drives the supply roller with a worm and a worm gear. The axle of the drive shaft is also the swivel axis for a hinged housing which supports the supply roller and the opening roller, the hinged housing also containing the cover for the spinning rotor. The hinged housing is supported independently from the rotor housing and is detachable at right angles to the swivel axis. Both the opening roller and the supply roller are accessible from the operational side when the hinged housing is in spinning position.

20 Claims, 5 Drawing Sheets

V
1
37
4
11
10
9
35
36
29
38
32
39
33
28
20
30
31
IV
22
23
12
21
13
5
2
6
E
15
14
26
3
19
16
18
25
8
24
7
17

OPEN-END ROTOR SPINNING UNIT WITH PIVOTAL COVER HOUSING ASSEMBLY

BACKGROUND AND SUMMARY OF THE INVENTION

The invention relates to an open-end rotor spinning unit with a spinning rotor, a supply roller and an opening roller, whose axles, in plan view, are arranged in parallel planes with respect to each other. A drive shaft containing a worm for driving the supply roller has an axle extending perpendicularly to the above mentioned planes and coaxially to a swivel axis of a hinged housing. The hinged housing is arranged at at least one mounting support to be pivotable from a rotor housing position containing the spinning rotor and supports the supply roller and the opening roller.

A device of this kind as disclosed in German patent 18 15 776 C2 represents the prior art. The hinged housing, which supports the supply roller and the opening roller, is also when in operation the cover for the device for open-end rotor spinning, without the supply roller and the opening roller being accessible from the outside. The hinged housing is linked with the rotor housing, which is supported on the hinged housing with an axle, by an adjustable mechanism in such a way that by swivelling the hinged housing into a maintenance position, the rotor housing is also pivotable, however in the opposite direction. The driving shaft for the supply roller is supported in a pipe, on which in turn the hinged housing is pivotally supported. Due to this type of mounting support, as well as the linkage between the rotor housing and the hinged housing, it is not possible to disassemble only the hinged housing alone for maintenance purposes.

From German published patent application 36 36 182 A1 it is known that a hinged housing supporting the supply roller and the opening roller is movably mounted from a stationary rotor housing without the rotor housing being linked to the hinged housing by an axle. Here however the axle of the driving shaft for the supply roller is not also the swivel axis for the hinged housing, so that the worm and the worm gear disengage when moved aside. The arrangement of the swivel axis in the interior of the device for open-end spinning makes it practically impossible to support the hinged housing in a simple way while making it detachable.

An object of the invention is to construct a device of the above mentioned kind which is maintenance-friendly.

This object is achieved in that the hinged housing is supported independently of the rotor housing while being detachable at right angles to the swivel axis.

By means of the design according to the invention, it is now possible to detach the hinged housing for maintenance purposes on the operational side, without the rotor housing having to be moved from its operational position.

In a development of the invention the hinged housing is pivotably slipped, with a fork-like brace formed in its fork base as a cylindrical surface, onto a suitably formed sliding surface of the mounting support. This type of mounting support makes it possible to detach the hinged housing at right angles to the swivel axis when required, without any fixtures having to be loosened.

The mounting support surrounds the drive shaft with a halfcylindrical interior contour with clearance space. This has the advantage on one hand that the mounting is not directly supported by the driving shaft and on the other that it is possible in addition to detach the drive shaft when required, without the mounting support with the hinged housing having to be dismantled first.

In an advantageous development of the invention the fork-like brace is provided with a size of jaw outside the cylindrical surface, which size of jaw is larger than the diameter of the drive shaft but smaller than the diameter of the cylindrical surface, whereby the sliding surface is interrupted secant-like by a flat surface, whose distance from the swivel axis is less than half the size of the jaw. Due to this design, the hinged housing is not detachable from the mounting support when in its operational position, rather a pivot movement to the maintenance position is necessary before the hinged housing can be detached at right angles to the swivel axis.

In especially preferred embodiments, the swivel axis is arranged in direct proximity to the opening roller. This has the particularly advantageous result that the hinged housing itself and especially the driving elements for the supply roller can be made very short and therefore save space.

It is advantageous when the hinged housing has an exchangeable part of a case, which exchangeable part contains at least one part of the fiber feed channel which extends from the opening roller to the spinning rotor. By removing the hinged housing, the cover for the spinning rotor is therefore removed at the same time, whereby a traditional separate movable part of the case is not needed.

The hinged housing, including the exchangeable part of the case, is designed advantageously as a cover for the operational side of the spinning device and in particular for the spinning rotor. This has the advantage that a separate additional cover for the open-end rotor spinning unit is not necessary.

In a particularly advantageous development of the invention, the supply roller as well as the opening roller in the hinged housing are accessible from the operational side when the hinged housing is in spinning position. This results in the advantage that—if necessary after the removal of the front end lid of the opening roller—important spinning elements such as the supply roller and the opening roller can be observed while in operation. Furthermore it results in the additional advantage that the area of the supply and opening rollers can be cleaned of fly from time to time while in operation without the hinged housing having to be moved over into a maintenance position.

In preferred embodiments, the opening roller is connected with a drive wharve, which is driven by a tangential belt which is situated between the drive wharve and the swivel axis. When the hinged housing is moved aside, the opening roller is separated at the same time from its drive source, which consists of a tangential belt arranged in direct proximity and parallel to the swivel axis.

The rotor housing is accordingly arranged in a stationary position. This has the advantage that the most important spinning element, namely the spinning rotor, can remain in its operational position for maintenance purposes, so that an accumulation of tolerances and an adjusting of the spinning rotor are avoided.

The axle of the opening roller is—in the side view—accordingly arranged inclined to the horizontal axle of the spinning rotor. This results in the advantage that a fiber feed channel arranged between the opening roller and the spinning rotor can be constructed in a straight line, which is favorable for the delivery of the separated single fibers.

Other objects, advantages and novel features of the present invention will become apparent from the following detailed description of the invention when considered in conjunction with the accompanying drawings.

DETAILED DESCRIPTION OF THE PREFERRED EMBODIMENTS

The open-end rotor spinning unit comprises the following main spinning elements: a spinning rotor 1, a fiber supply roller 2 and an opening roller 3.

Figure 1:
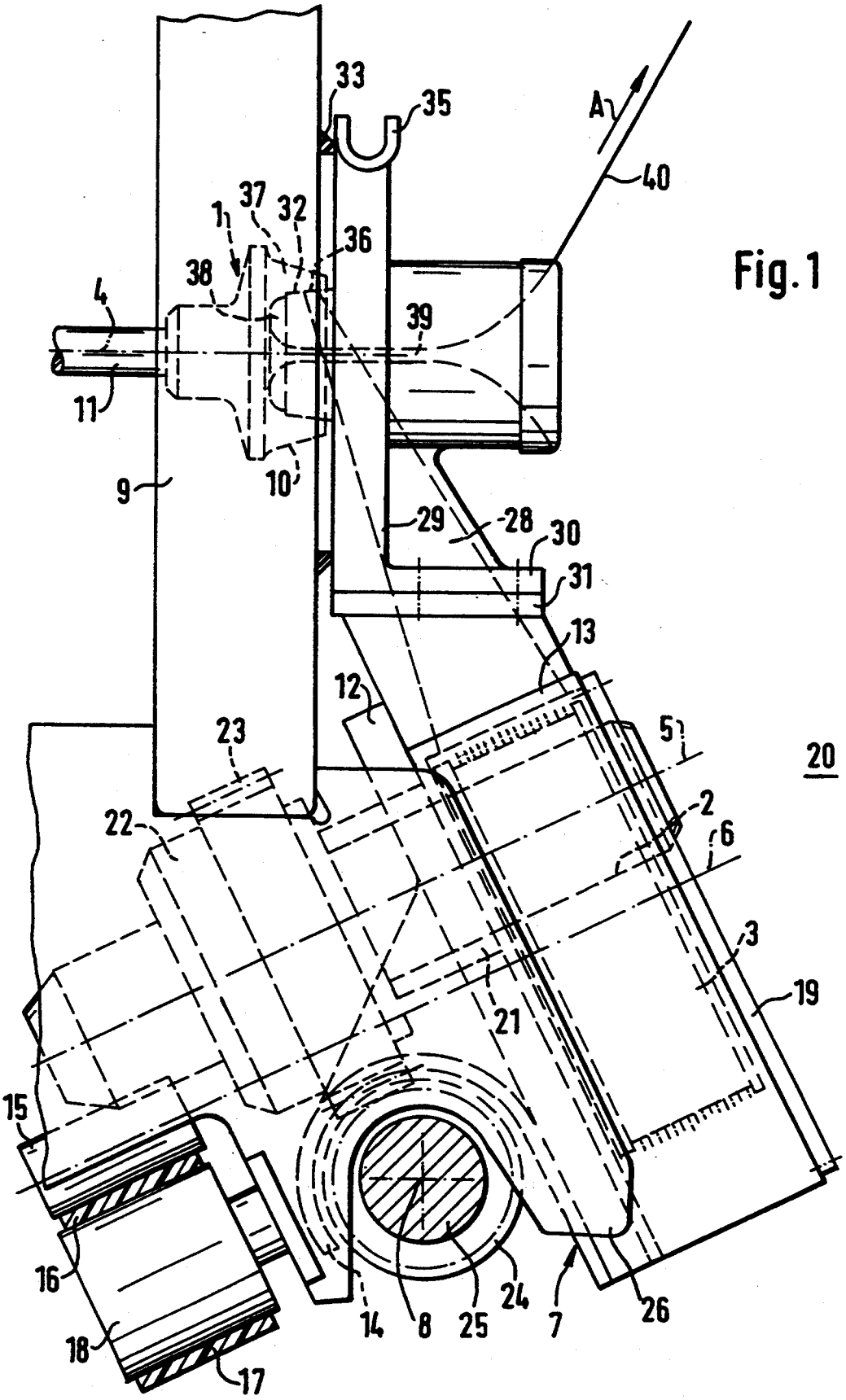
FIG. 1 is a partly sectional side view of the device for open-end rotor spinning shown while in operation and constructed according to a preferred embodiment of the invention.
Figure 5:
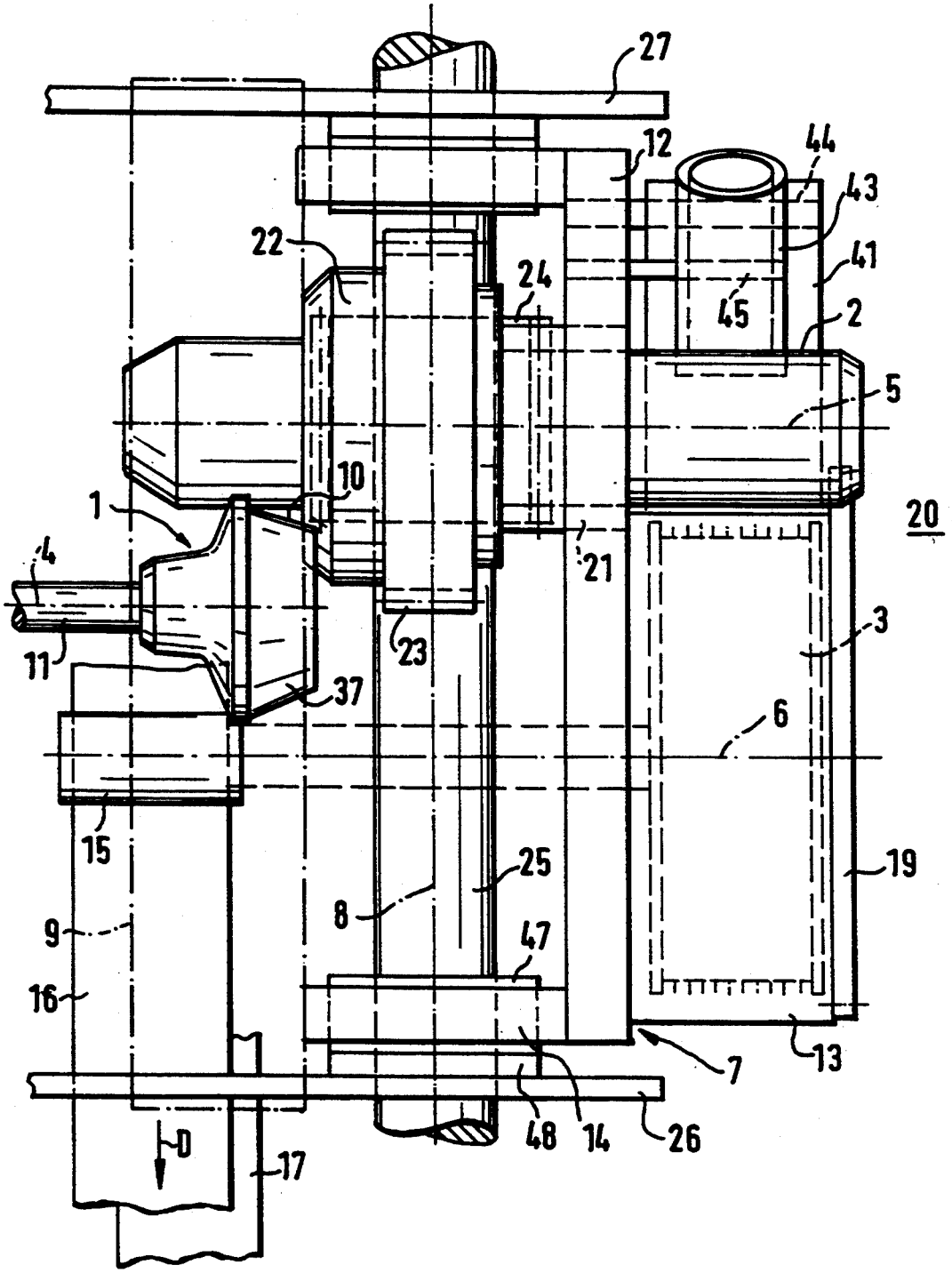
FIG. 5 is a view in the direction of arrow V from FIG. 2, whereby the part of case containing the fiber feed channel has been left out and the rotor housing is indicated only by a dot-dash line.

The axles 4, 5 and 6 of the spinning rotor 1, the fiber supply roller 2 and the opening roller 3 are arranged—in plan view as shown in FIG. 5—in parallel planes to each other. The axles 5 and 6 of the fiber supply roller 2 and the opening roller 3 are however—in side view as shown in FIG. 1—arranged with respect to the axle 4 of the spinning rotor 1 at an angle of approximately 25°. The axles 5 and 6 of the supply roller 2 and the opening roller 3 are parallel to each other.

The supply roller 2 and the opening roller 3 are supported in a hinged housing 7, which can be pivoted by means of a stationary swivel axle 8 into a maintenance position. This will be described later. The swivel axle 8 extends perpendicularly to the above mentioned planes in direct proximity to the opening roller 3.

The spinning rotor assembly 1 comprises a rotor or rotor dish 10 and a rotor shaft 11 attached to it. The rotor dish 10 is arranged in a known way in the interior of a low pressure rotor housing 9, which is mounted in a stationary position. The rotor shaft 11 is sealed at the point where it penetrates the rear wall of the rotor housing 9 and is arranged and driven outside of it (not shown).

The hinged housing 7 contains as the main component a flat plate 12, to which, among others, a detachable opening roller housing 13 surrounding the opening roller 3 is arranged. The plate 12 supports further a brace 14 which is used for supporting and swivelling the hinged housing 7 in a way which will be described later.

The opening roller 3 is connected with a drive wharve 15 which, when the device is in operational position as shown in FIG. 1, lies against a tangential belt 16. The tangential belt 16 extends between the drive wharve 15 and the swivel axis 8 in longitudinal direction of an open-end rotor spinning machine which comprises a plurality of spinning devices, and is pressed against the drive wharve 15 by a tension pulley 18 which is supported by the device, and which also feeds the returning end of the tangential belt 16.

The interior of the opening roller housing 13 is accessible from the operational side 20 of the device after removal of a lid 19 which covers the front end of the opening roller 3. The lid 19 is advantageously connected with the opening roller housing 13 by means of a quick acting closure (not shown). The bearings of the opening roller 3 (not shown in detail) are on the rear side of the plate 12.

The supply roller 2 is also mounted onto the plate 12 with a bearing housing 21. It is connected in a known way with an electromagnetic clutch 22, which is connected to a thread guard (not shown) and which stops the supply roller 2 by means of disengaging the clutch 22 when a thread break occurs. The driving means of the supply roller 2 comprises a worm gear 23 fixed coaxially to its axle 5, which is driven by a worm 24 fixed to a drive shaft 25. The axle of the drive shaft 25 extends coaxially to the swivel axis 8, so that when the hinged housing 7 is moved aside the worm gear 23 does not disengage from the worm 24.

The hinged housing 7 is mounted on stationary side walls 26 and 27 of the device, which will be described later.

While in operation, as shown in FIG. 1, the opening roller 3 is linked to the spinning rotor 1 by means of a fiber feed channel 28, which is arranged partly in the opening roller housing 13 and partly in a separate exchangeable part of case 29. The part of case 29 has for this purpose a flange 30 which can be screwed onto a related flange 31 of the opening roller housing 13.

A slightly conically formed extension 32 is attached to the part of case 29 which projects into the interior of the rotor 10 during operation, as shown in FIG. 1. The extension 32 leaves in a known way a ring gap for outgoing air on the front side of the rotor 10. The part of case 29 positions itself while in operation with a seal 33 next to the rotor housing 9, thereby sealing off the interior of the rotor housing 9 on the operational side 20. The mouth 36 of the fiber feed channel 28 which lies inside the rotor 10 is arranged against a conical sliding wall 37 of the rotor 10, from which the fed-in fibers are delivered into a fiber collecting groove, where they are then twisted together into a thread 40 and fed in arrow direction A to a take-up device (not shown) through a navel 38 fixed to the extension 32 and through a yarn withdrawal channel 39 in the part of case 29.

Figure 4:
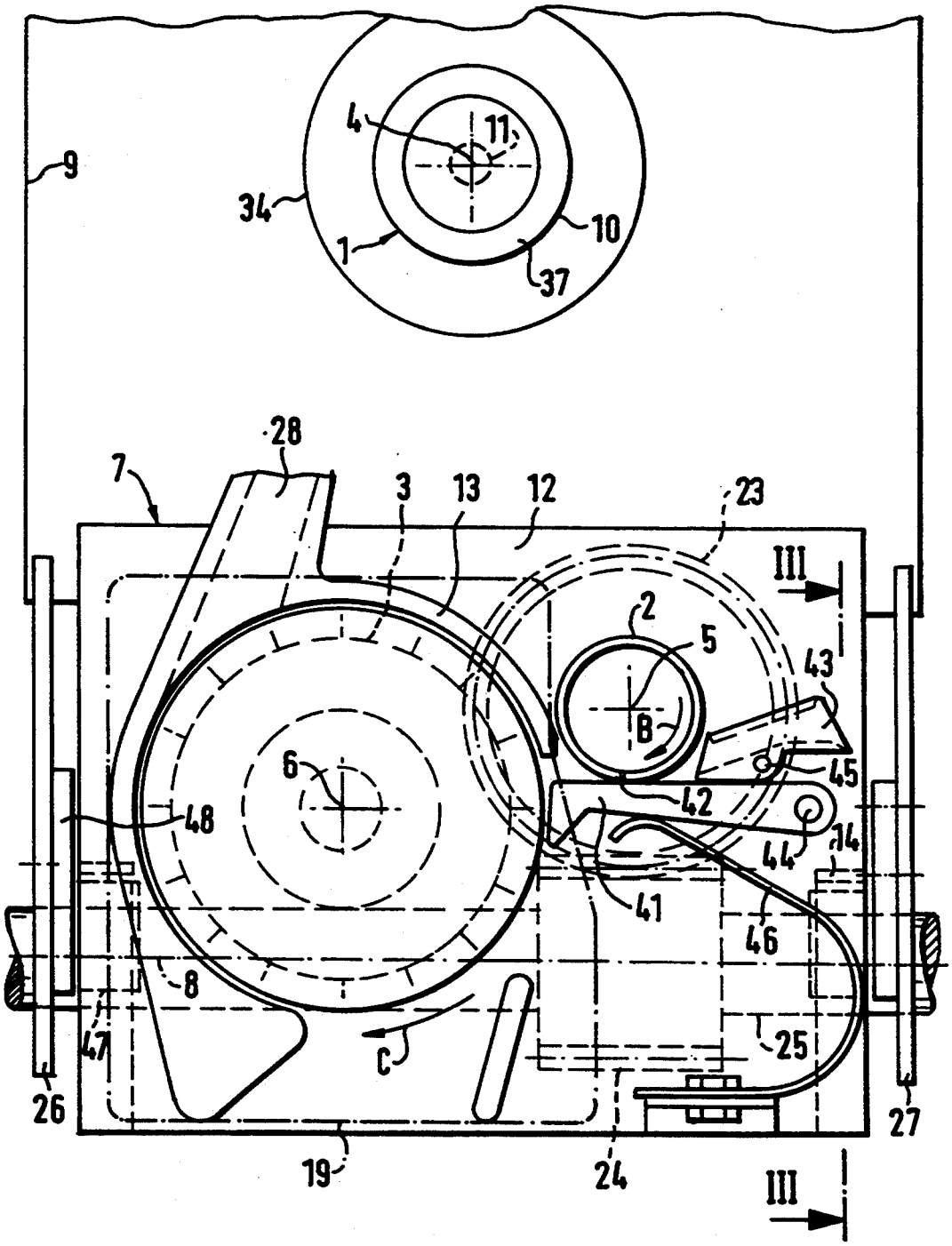
FIG. 4 is a view in the direction of arrow IV as shown in FIG. 2, whereby the part of case containing the fiber feed channel has been left out and whereby the front end cover of the opening roller is indicated only by a dot-dash line.

While in operation the supply roller 2 and the opening roller 3 are driven in the respective arrow directions B and C as shown in FIG. 4. The driving means of the opening roller assembly 3 is effected by the tangential belt 16 which runs in arrow direction D.

A feed table 41 for delivering the sliver (not shown) belongs to the supply roller 2, the said feed table 41 forming a nipping line 42 with the circumference of the supply roller 2, and being pressed against the supply roller 2 by means of a load spring 46. The feed table 41 is pivotable around a bolt 44 fixed to the plate 12. The supply roller 2 is linked to a so-called condenser 43, which is also pivotable around a bolt 45 fixed to the plate 12 and which supports itself from above against the feed table 4 1.

Figure 2:
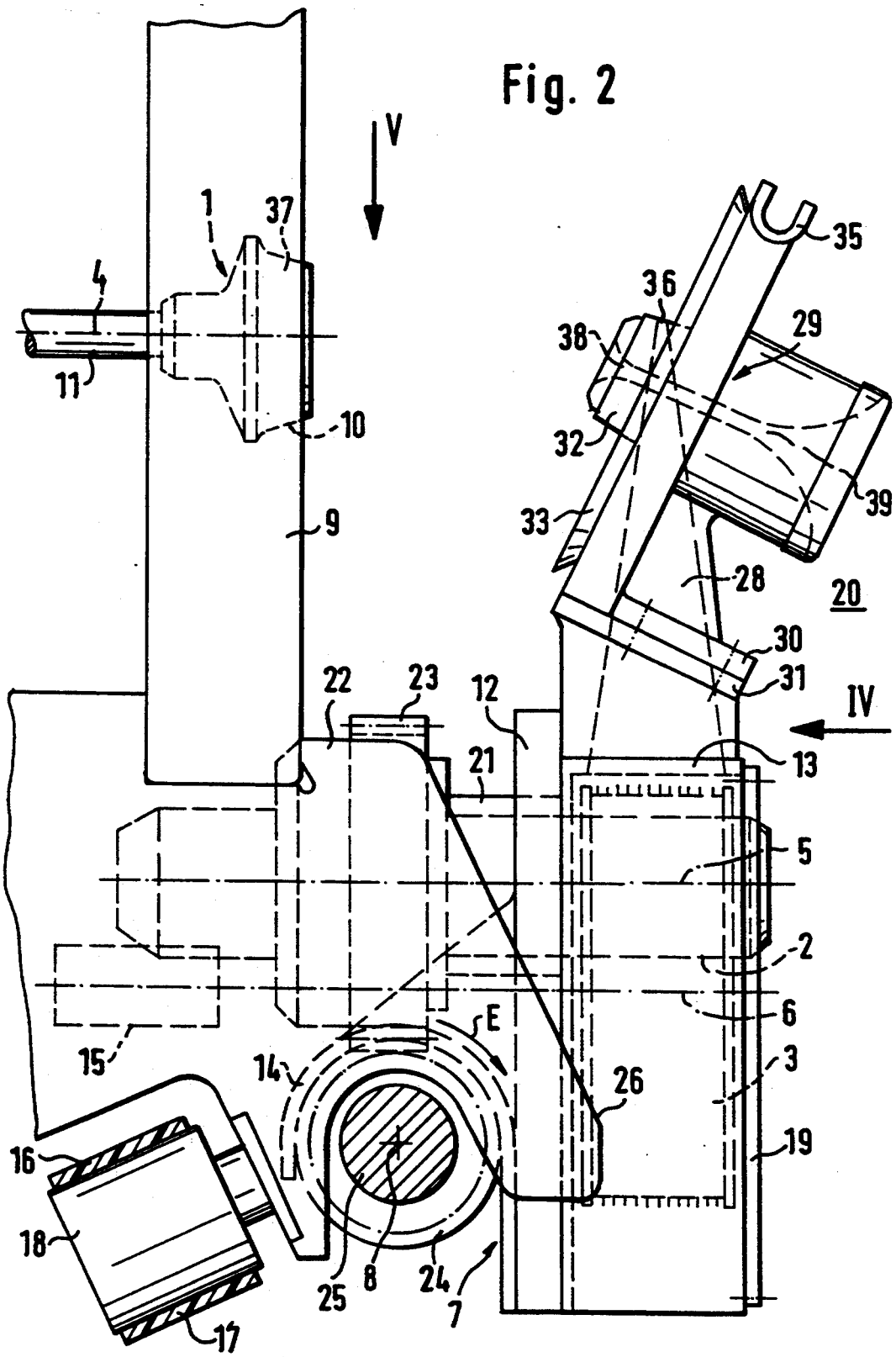
FIG. 2 is the device as shown in FIG. 1 in which the hinged housing supporting the supply roller, the opening roller and the fiber feed channel has been swivelled into a maintenance position.

The hinged housing 7 together with the part of case 29 forms on the operational side 20 the cover for the device while in operation. This cover, when required, is pivotable around the swivel axis 8, for example in an inter-position as shown in FIG. 2, or around a much larger angle. After the lid 19 has been removed, the front side of the supply roller 2 and the front side of the opening roller 3 remain accessible from the operational side 20, even while in operation, as shown in FIG. 1. Operation of the arrangement is secured by a locking device, on release of which the spinning rotor 1 is, in a known way, simultaneously braked.

After the hinged housing 7 has been pivoted around the swivel axis 8, it is then detachable at right angles from the swivel axis 8 without any screwed joints or the like having to be released first. This will be described with the aid of FIG. 3 as follows:

Half-cylindrical supports 47 made of plastic are fixed to the side walls 26 and 27 which support the arrangement for open-end rotor spinning. The supports 47 are each provided with a flange 48, which is screwed onto one of the side walls 26 or 27 by means of screws 49. The inner contour 50 of each support 47 surrounds the drive shaft 2 5 with clearance space, whereby the drive shaft 25 is not mounted in the area of each single spinning unit, but rather in the area of every fourth or sixth one.

The supports 47 are provided with a sliding surface 51 on the outer sides, which in principal is formed as a half-cylindrical surface, whose axle extends coaxially to the swivel axis 8. The fork-shaped brace 14 of the hinged housing 7 is mounted pivotably and sliding on this sliding surface 51, the said brace 14 being provided with a cylindrical surface 52 in the fork base.

This half-cylindrical form design of the supports 47, as well as the fork-like design of the brace 14 make it possible to detach the driving shaft 25 downwards without having to dismantle the supports 47 or the hinged housing 7.

The half-cylindrical sliding surface 51 of each support 47 is interrupted secant-like by a flat surface 53 in such a way that the cylindrical surface 52 of the brace 14 in this area does not lie on the support 47. This flat surface 53 facilitates the removing of the hinged housing 7 from its two supports 47 in the following way:

The brace 14 is extended downwards in a slight fork shape beyond the cylindrical surface 52, whereby the fork has a size of jaw t, which is larger than the diameter of the drive shaft 25 but smaller than the diameter of the cylindrical surface 52. This has the result that, for example, the brace 14 cannot be removed upwards, as shown in the position marked by continuous lines in FIG. 3.

Figure 3:
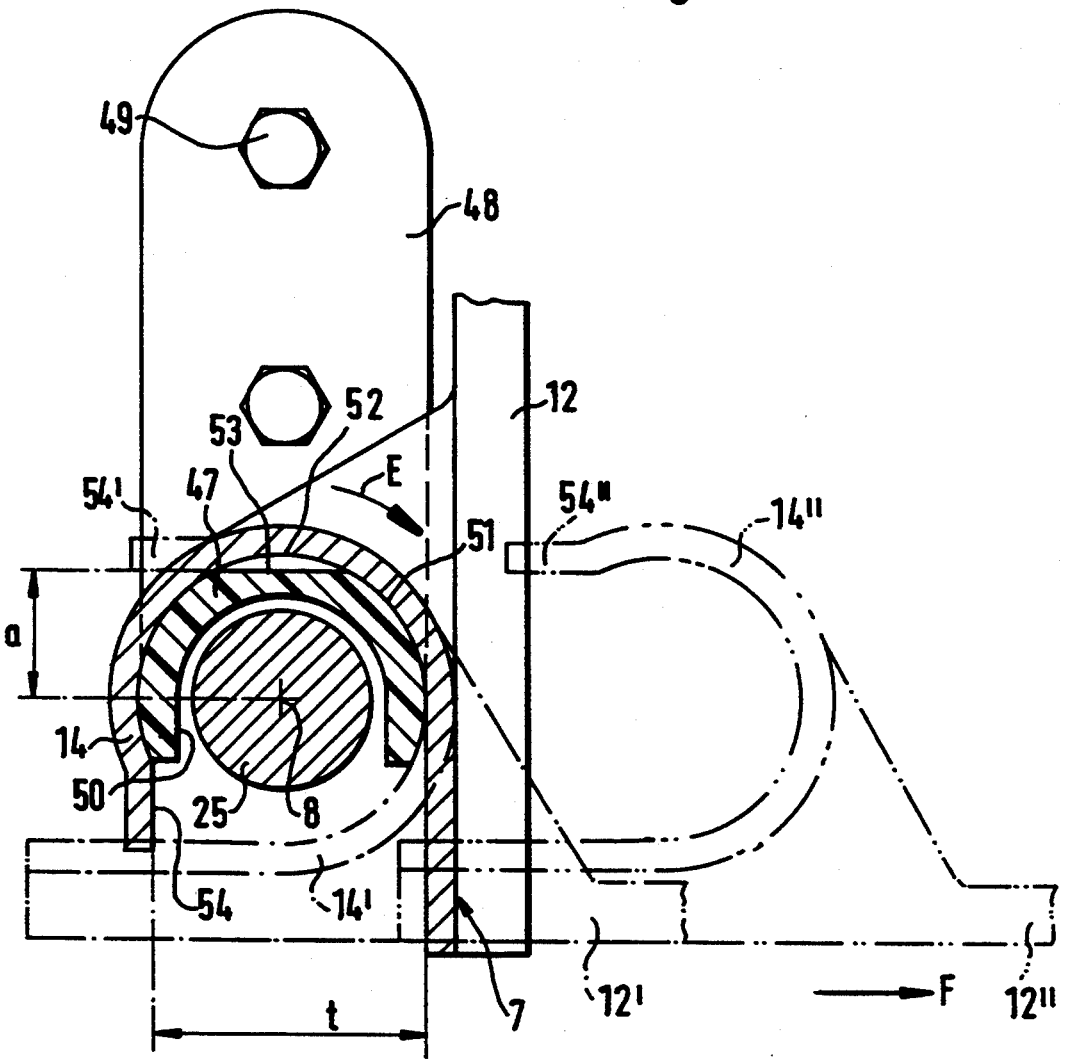
FIG. 3 is a somewhat enlarged illustration of the area of the swivel axis of the hinged housing along the section surface III—III of FIG. 4, showing three different positions of the hinged housing.

The above-mentioned flat surface 53 has a distance (a) from the swivel axis 8, which is smaller than half the size of jaw t. When the hinged housing 7 is moved in arrow direction E, a flat surface 54 of the fork-shaped brace 14 comes to rest on the flat surface 53 after a pivoting angle of about 90° (see position 54' marked by dot-dash lines), in which the plate 12 of the hinged housing 7 holds the position 12'. In this moved aside position, the hinged housing 7 can be removed in arrow direction F from the swivel axis 8, as shown in FIG. 3 (see positions 12'', 14'' and 54''). In order to place the hinged housing 7 onto the supports 47, the hinged housing 7 must be slipped onto the flat surface 53 in the opposite direction to arrow direction F, whereby the worm gear 23 can be carefully engaged with the teeth of the worm 24. The teeth of the worm gear 23 do not however disengage from the worm 24 just by being moved aside.

As can be seen particularly in FIG. 1, the distance between the supply roller 2 and the worm gear 23 which drives it is extremely small. As seen from the operational side 20, the arrangement of the spinning and driving elements follow this order:

supply roller 2 and opening roller 3,
drive shaft 25
tangential belt 16

The device for open-end rotor spinning is therefore very maintenance-friendly whether for normal spinning operations or when the hinged housing 7 is moved aside away from the rotor housing 9, or even in special cases detached at right angles to the swivel axis 8.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An open-end spinning unit comprising:

a spinning rotor mounted on a first axle for spinning fiber material supplied thereto, a rotor housing at least partly surrounding the spinning rotor, an opening roller mounted on a second axle for opening fiber material to be supplied to the spinning rotor, a supply roller mounted on a third axle for supplying fiber material to the opening roller, a supply roller drive assembly mounted on a fourth axle for driving the supply roller, and:

a hinged housing supported by a swivel axle and covering said spinning rotor, said hinged housing supporting said opening roller and said supply roller for movement therewith, said hinged housing being movable between a closed operating position and an open non-operating position, wherein said first, second and third axles are arranged in parallel planes, wherein said fourth axle is arranged perpendicularly to said planes and extends coaxially to said swivel axle, wherein said supply roller drive assembly includes a first gearwheel which is fixed to and coaxial with the fourth axle, and wherein a second gearwheel is fixed to and coaxial with the third axle, said first and second gearwheels being directly drivingly engaged with one another.

2. A spinning unit according to claim 1, wherein the swivel axle is arranged in direct proximity to the opening roller.

3. A spinning unit according to claim 1, wherein the hinged housing is provided with an exchangeable part of a case, which exchangeable part comprises at least one part of a fiber feed channel extending from the opening roller to the spinning rotor.

4. A spinning unit according to claim 3, wherein the hinged housing, including the exchangeable part, forms a cover for an operational side of the spinning unit spinning rotor.

5. A spinning unit according to claim 4, wherein the supply roller as well as the opening roller are accessible from the operational side when the hinged housing is in its closed operation position.

6. A spinning unit according to claim 5, wherein the hinged housing includes a fork-like brace comprising a cylindrical surface in the fork base which is pivotably slipped onto an accordingly formed sliding surface of a support of the swivel axle.

7. A spinning unit according to claim 5, wherein the opening roller is connected with a drive shaft which is driven by a tangential belt.

8. A spinning unit according to claim 1, wherein the opening roller is connected with a drive shaft which is driven by a tangential belt.

9. A spinning unit according to claim 1, wherein the rotor housing is arranged in a stationary position.

10. A spinning unit according to claim 1, wherein the first axle is arranged horizontally and wherein the second axle is arranged inclined towards the first axle.

11. An open-end unit according to claim 1, wherein said hinged housing is supported independently of the rotor housing and is detachable at right angles to said swivel axis.

12. An open-end unit according to claim 11, wherein the hinged housing includes a fork-like brace, comprising a cylindrical surface in the fork-like brace which is pivotably slipped onto an accordingly formed sliding surface of a support of the swivel axle.

13. An open-end spinning unit comprising:

a spinning rotor mounted on a first axle for spinning fiber material supplied thereto, a rotor housing at least partly surrounding the spinning rotor, an opening roller mounted. On a second axle for opening fiber material to be supplied to the spinning rotor, a supply roller mounted on a third axle for supplying fiber material to the opening roller, a supply roller drive assembly mounted on a fourth axle for driving the supply roller, and a hinged housing supported by a swivel axle and covering said spinning rotor, said hinged housing supporting said opening roller and said supply roller for movement therewith, said hinged housing being movable between a closed operating position and an open non-operating position, wherein said first, second and third axles are arranged in parallel planes, wherein said fourth axle is arranged perpendicularly to said planes and extends coaxially to said swivel axle, wherein said hinged housing is supported independently of the rotor housing and is detachable at right angles to said swivel axis, and wherein the hinged housing includes a fork-like brace, comprising a cylindrical surface in the fork-like brace which is pivotably slipped onto an accordingly formed sliding surface of a support of the swivel axle.

14. A spinning unit according to claim 13, wherein the support at least partially surrounds a drive shaft of the supply roller drive assembly with a hollow half-cylinder like inner contour with clearance space.

15. A spinning unit according to claim 14, wherein the fork-shaped brace has a size of jaw outside of the cylindrical surface which size of jaw is larger than the diameter of a drive shaft of the supply roller drive assembly, but smaller than the diameter of the cylindrical surface, and wherein the sliding surface is interrupted secant-like by a flat surface, spaced a distance from the swivel axle which is smaller than half the width of the size of jaw.

16. A spinning unit according to claim 13, wherein the fork-shaped brace has a size of jaw outside of the cylindrical surface which size of jaw is larger than the diameter of a drive shaft of the supply roller drive assembly, but smaller than the diameter of the cylindrical surface, and wherein the sliding surface is interrupted secant-like by a flat surface, spaced a distance from the swivel axle which is smaller than half the width of the size of jaw.

17. A spinning unit according to claim 16, wherein the swivel axle is arranged in direct proximity to the opening roller.

18. A spinning unit according to claim 16, wherein the hinged housing is provided with an exchangeable part of a case, which exchangeable part comprises at least one part of a fiber feed channel extending from the opening roller to the spinning rotor.

19. A spinning unit according to claim 13, wherein the swivel axle is arranged in direct proximity to the opening roller.

20. A spinning unit according to claim 13, wherein the hinged housing is provided with an exchangeable part of a case, which exchangeable part comprises at least one part of a fiber feed channel extending from the opening roller to the spinning rotor.

* * * * *